US006076848A

United States Patent [19]

Rigal et al.

[11] Patent Number: 6,076,848

[45] Date of Patent: Jun. 20, 2000

[54] STRAP CONNECTION DEVICE FOR A BOOT

[75] Inventors: Jean-Pierre Rigal, La Balme De Sillingy; Christophe Chedal Anglay, Cran Gevrier, both of France

[73] Assignee: Salomon S.A., Metz-Tessy, France

[21] Appl. No.: 08/961,214

[22] Filed: Oct. 30, 1997

[30] Foreign Application Priority Data

Oct. 31, 1996 [FR] France ..... 96.13491

[51] Int. Cl.[7] ..... A63C 5/04

[52] U.S. Cl. ..... 280/634; 280/809; 280/14.2; 24/709 K

[58] Field of Search ..... 280/607, 623, 280/617, 618, 633, 634, 14.2, 809; 36/117, 120, 122, 125, 54; 24/709 K

[56] References Cited

U.S. PATENT DOCUMENTS

| | | | |
|---|---|---|---|
| 4,979,760 | 12/1990 | Derrah | 280/607 |
| 5,356,170 | 10/1994 | Carpenter et al. | 280/618 |
| 5,416,952 | 5/1995 | Dodge | 24/68 R |

FOREIGN PATENT DOCUMENTS 9113766 4/1992 Germany .

*Primary Examiner*—Richard M. Camby
*Attorney, Agent, or Firm*—Greenblum & Bernstein, P.L.C.

[57] ABSTRACT

A device for connecting a sports boot intended to be attached to a glide board for snowboarding by at least one strap that includes a padding directed towards the boot, located in the instep zone. The padding of the strap includes an arrangement that distributes the tightening pressure exerted thereby on the instep, so as to obtain a central pressure corresponding to the zone of the big toe levator tendon, that is less than the lateral pressures exerted on either side thereof.

36 Claims, 3 Drawing Sheets

6
5d
3
9
60
61
8
31
30
5a
50
5c
5
51
5b 30
5a
6
11
3
10
12
5b
31
9
60
50
5
51
61
8

30
9
11
6
10
5c
12
8
31
3
11a
5d
12a 30
3
31
14
6
13
15
5

STRAP CONNECTION DEVICE FOR A BOOT

BACKGROUND OF THE INVENTION

1. Field of the Invention

The invention is related to a connection device for a sports boot intended to be associated with a glide board for snowboarding, the boot including an upper affixed to a sole adapted to cooperate directly or indirectly with the board.

2. Description of Background and Relevant Information

There are a variety of systems for binding a boot on a board in the practice of the above-mentioned discipline. A first system is related to connecting stiff downhill ski boots that are attached to the board by front and rear stirrup elements and whose latching control is located on one of the stirrups, and is actuated by a manual or an automatic action. This system is not the most widespread one due to the fact that the stiffness of the boots results in substantial disadvantages in terms of functionality and comfort.

The most prevalent system at this time is related to devices for binding flexible boots on the board via a shell that is fixed to the board. This shell includes a certain number of straps intended to affix the boot in the shell. The invention is specifically related to this second type of binding device.

A shell of this type has been described, for example, in U.S. Pat. No. 5,356,170. The invention is not related only to the connection of the boot on the shell, but to any connection of a boot on a glide board, generally including at least one strapping element intended to tighten the boot with respect to the board, more specifically, by means of at least one strap located in the area of the instep.

This type of strap is usually stiff and lined with a relatively flexible inner padding directed towards the boot in the area of the instep. It has been noted that although this padding provides a certain level of comfort during use, such comfort was not completely ensured in some cases, as for instance, when the boot is bent forwardly while snowboarding.

Indeed, in this position, the levator tendon of the big toe which works when the foot is bent, bulges out on the instep and the tightening applied by the strap on said tendon causes an irritation, and sometimes even pain.

SUMMARY OF THE INVENTION

On the basis of the foregoing observations, an object of the invention, according to a first phase of inventive activity, is to distribute the tightening pressures exerted by the strap, so as to avoid exerting a pressure on the levator tendon.

To this end, the invention is directed to a connection device of a sports boot equipped with at least one strap including a padding of the above cited type, wherein the padding of the strap includes an arrangement that distributes the tightening pressure exerted by such strap on the instep, so as to obtain a central pressure corresponding to the big toe tendon zone, that is less than the lateral pressures exerted along either side thereof.

According to a preferred embodiment, the pressure distribution arrangement of the strap on the padding element includes a central hollowed space demarcated laterally by two lateral projecting shapes that jut out on either side of the central space so as to constitute a housing for the tendon of the big toe. Due to this, the shape of the strap in contact with the corresponding part of the boot is adapted to take the anatomical specifications of the covered region into account.

Other characteristics of this embodiment as well as examples of other possible embodiments will be provided in the description that follows hereinafter.

It will be readily apparent that the solution proposed by the invention includes using means for distributing pressure along an anatomical portion of the foot. It is important to center the strap with great precision so that the zone with less pressure is located at the exact area of the tendon, and is not off-set with respect thereto.

However, currently known means for tightening a strap on the instep do not allow this result to be obtained, at least not efficiently and quickly.

In a known manner, the strap generally comprises two separate portions, each connected along one side of the shell or affixing base, and having two free ends that can be connected together and adjusted during tightening via a closure means of the ratchet type, for example. One of the strap portions includes the padding that bears the closure device, whereas the other is a serrated portion cooperating by incrementation with the closure device.

It is well understood that the tightening obtained by unilateral traction on the portion bearing the padding, that is moreover attached at its other end to a fixed portion of the shell, does not allow for the correct centering adjustment of said padded portion so that it adapts to the various boot volumes to be tightened.

Another known device for connecting a boot on a board is known, wherein the strap, still constituted of two parts, includes, on the one hand, a first tightening means acting on the free ends of both strap portions, and a centering means located at the end of the strap portion bearing the padding affixed to a fixed portion of the shell. These latter means are constituted of a plurality of holes that one selects depending on the centering desired.

Such a means is useful in adjusting the length of the strap but is ill-suited for adjusting the centering of the padded portion in an efficient and quick manner. Any attempt at adjusting the centering means by means of a plurality of holes implies a long and arduous process.

In order to overcome this disadvantage, and according to another feature of the invention, the padded portion is provided on a reinforcement or removable support element interposed between two serrated strap portions so as to constitute a third central element thereof whose ends are connected to the free ends of both of said serrated strap portions by means of two separate latching devices, thus enabling an easier and quicker centering of the padded support element with respect to the instep.

The invention is also related to the characteristics that will become apparent from the description that follows, and these should be considered alone as well as in all possible technical combinations thereof.

BRIEF DESCRIPTION OF THE DRAWINGS

This description, provided as a non-restrictive example, will enable a better understanding of how the invention can be obtained with reference to the annexed drawings wherein.

DETAILED DESCRIPTION OF THE PREFERRED EMBODIMENTS

Figure 1:
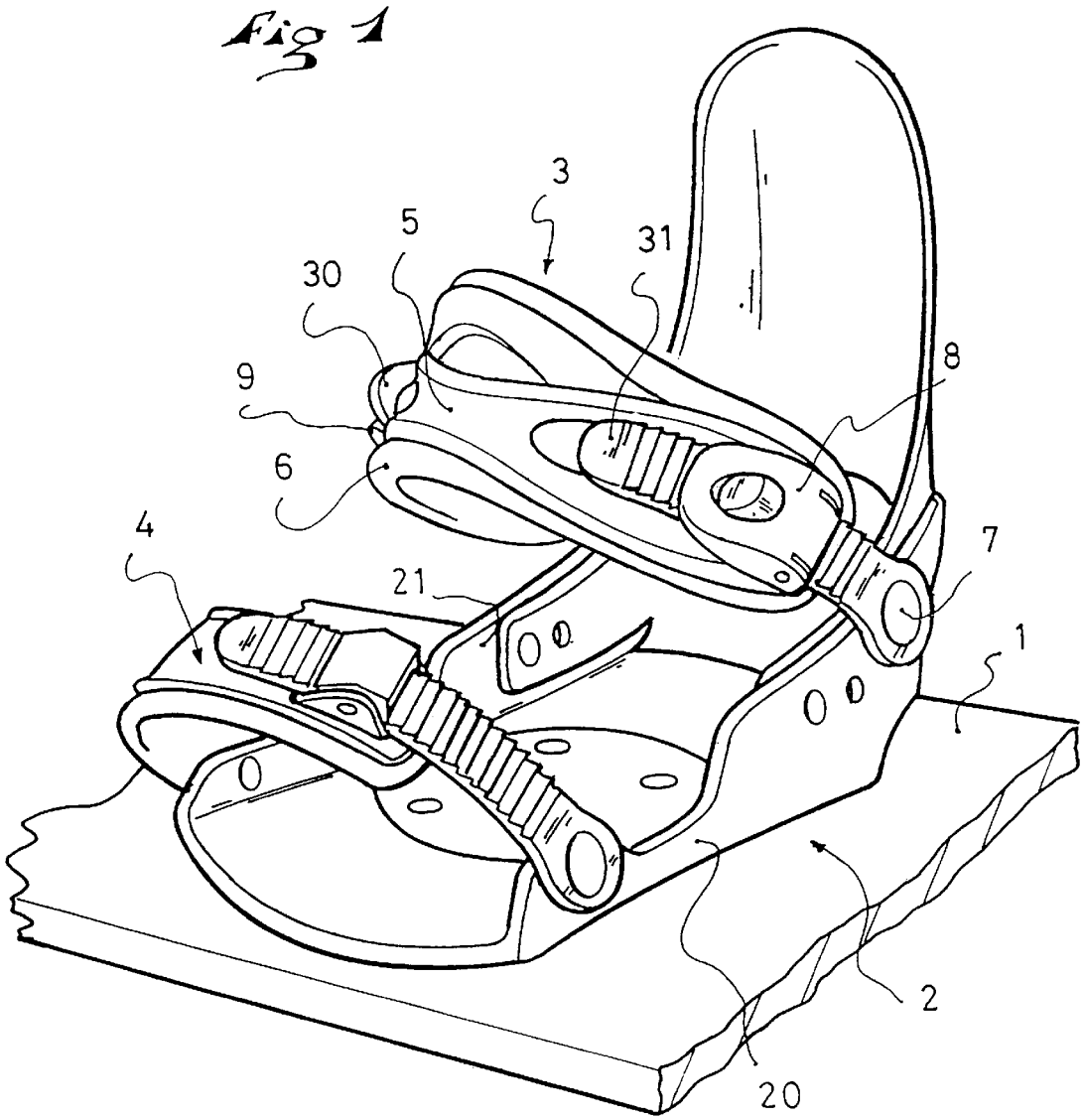
FIG. 1 is a perspective view of a portion of the glide board on which is located an affixing shell for a boot equipped with a connecting device, according to the invention.

FIG. 1 represents a portion of the glide board 1 along which is arranged a shell 2 adapted to retain a boot (not represented). The shell 2 includes a device for connection with the boot, the device having two straps 3 and 4. Strap 3 is intended to tighten the boot in the area of the instep, whereas the other strap 4 is intended to tighten the front foot portion of the boot, in the area solely of the toes. The invention is related solely to strap 3, that is semi-rigid and comprises a support element 5 lined with a relatively flexible inner padding in the form of a padding element 6 attached to the support element 5 and directed towards the boot.

Preferably, the support element 5 is a traction resistant flexible band that is preferably made of a plastic material.

In addition, strap 5 includes two serrated strap portions 30, 31 located on either side of the support element 5 and whose strap 3 ends are connected on the lateral sides 20, 21 of shell 2 by means of journals 7.

Strap 3 also comprises latching devices 8 and 9, of the ratchet latch type, fixed on the two ends of the support element 5 that cooperate via incrementation with the free ends of the two serrated strap portions 30, 31, so as to allow the boot to be released or immobilized after a gradual tightening operation, that is undertaken, for example, by exerting traction on the strap portions 30, 31 bringing them towards one another.

According to the invention, the inner padding element 6 of strap 3 includes a pressure distribution arrangement to distribute the tightening pressure that is exerted by the strap on the instep, so as to obtain a lesser central pressure in the zone corresponding to the big toe levator tendon as compared to the lateral pressures exerted on either side thereof.

Figure 2:
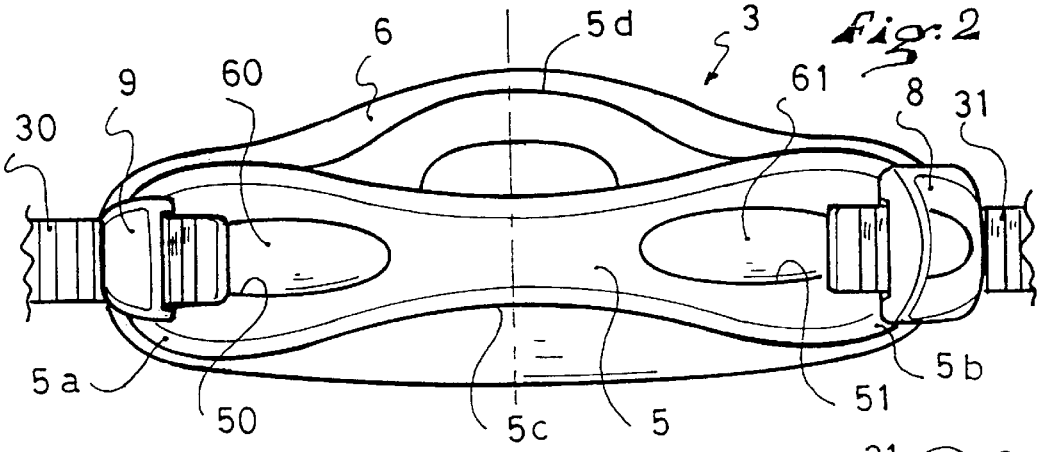
FIG. 2 is a front planar view of a central strap portion constituting the pressure distribution arrangement according to an embodiment of the invention.
Figure 3:
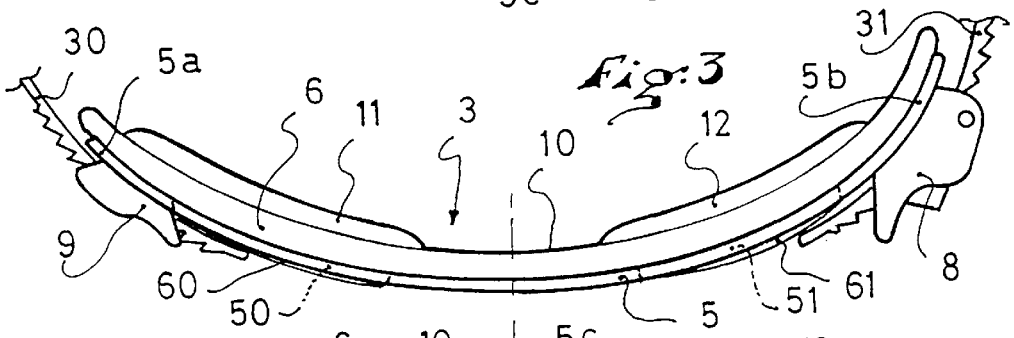
FIG. 3 is a side view of the strap portion as represented in FIG. 2.
Figure 4:
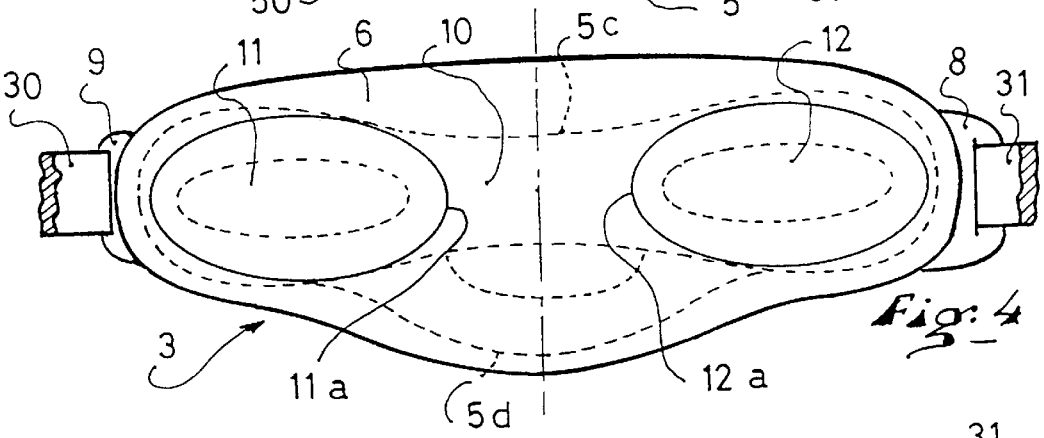
FIG. 4 is a rear planar or inner view of the strap portion according to FIG. 2.

According to the embodiment represented in FIGS. 2, 3, and 4, the pressure distribution arrangement of the strap 3 of the inner padding element 6 are constituted by a central hollowed space 10 demarcated laterally by two lateral projecting shapes 11 and 12, arranged juttingly on either side of the space 10, so as to constitute a housing for the tendon of the big toe.

According to a preferred embodiment, the lateral projecting shapes 11 and 12 have a generally ovoid shape, centered at one point, whose peak 1 la and 12*a* is directed towards the central space 10 so as to be ergonomically adapted to the bending fold of the instep. Element 6 can be made all in one piece, that is elongated and configured so as to obtain the general shape desired.

As can be seen in FIG. 2, the support element 5 includes longitudinally spaced slots 50, 51, in which the padded parts 60, 61 of the padding element 6 are positioned, the padded parts having a shape that complements the shapes of slots 50, 51 so as to facilitate the positioning and so as to increase the grip of the padding element 6 on the support element 5.

The padding element 5 is obtained by molding at least one element, preferably made of foam, the element being enveloped in a flexible envelope and attached on strap 3 by any affixing means.

The flexible envelope can be selected, for example, from among flexible plastic films such as PVC, natural or synthetic textile films, or even leather. The assembly of the envelope over the foam can be done via different means, such as, for example, stitching, or adhesive.

Similarly, the affixing means of the padding element 6 on the support element 5 of strap 3 can be constituted of a stitch, riveting, adhesive, or even by the use of high frequency welding.

The padding 6 can thus be obtained by duplicate molding of the same foam having the same density or different densities as required, and be obtained directly on the support element 5 of strap 3. Among the foams selected, one can cite the use of polyurethane or polyethylene.

According to another preferred characteristic of the invention enabling the correct and centered positioning of the strap, the support element 5 is interposed between the two strap portions 30, 31 so as to constitute a third central element. The ends 5*a*, 5*b* of the support element 5 are connected to the free ends of both of the serrated portions 30, 31 of strap 3 by means of two separate latching devices 8, 9 fixed on the ends 5*a*, 5*b*.

In this way, the two latching devices 8, 9 can act independently as regards the centering of the padded support element 5 with respect to the instep.

For example, the latching devices 8 and 9 are constituted, on the one hand, of an incremental advance device 8 equipped with a manoeuvering lever and a ratchet, of the type as described in the U.S. Pat. No. 5,416,952, allowing a progressive tightening to be obtained, and on the other hand, of an adjustment device with a simple ratchet 9 enabling, independently of the previous means, the centering of support element 5, and thus of padding element 6 with respect to the levator tendon of the big toe to be obtained. The strap can also include a simple ratchet mechanism on both sides or even include a latching device of another type.

As is shown in FIGS. 2, 3 and 4, the removable padded support element 5, constituting the central portion of strap 3, is asymmetrical with respect to the median longitudinal axis so as to make it reversible, and thus offer, depending on the side selected, a relative flexibility and stiffness, so as to constitute varying supports whose choice is made by the user.

It is in this spirit that according to an embodiment of the invention, the support element 5 comprises a concave longitudinal side 5*c* constituting the flexible support and an opposing convex longitudinal side 5*d* constituting the stiff support.

Figure 5:
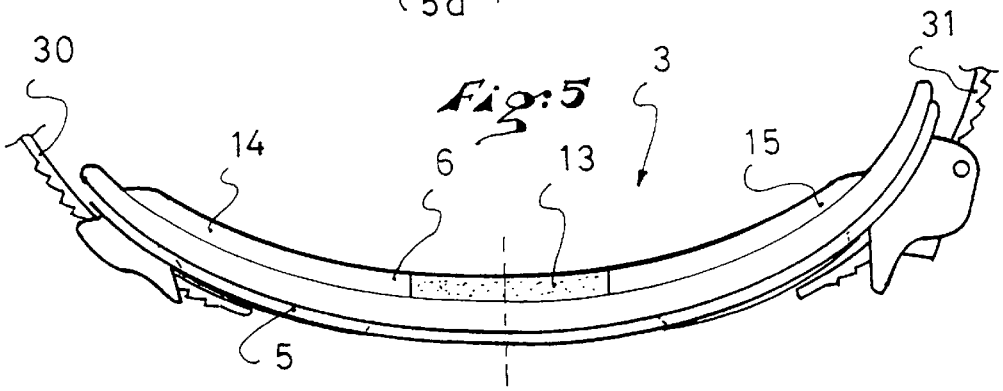
FIG. 5 is a side view of a central strap portion showing the pressure distribution arrangement according to another embodiment of the invention.

According to the variation represented in FIG. 5, the arrangement for distributing the pressure of strap 3 along the inner padding element 6 include materials whose component elements have varying densities, the material corresponding to the central zone 13 having lower density than the material corresponding to the two lateral adjacent zones 14, 15 so as to form a central zone 13 that is adapted to be compressed in order to absorb the tendon of the big toe.

Figure 6:
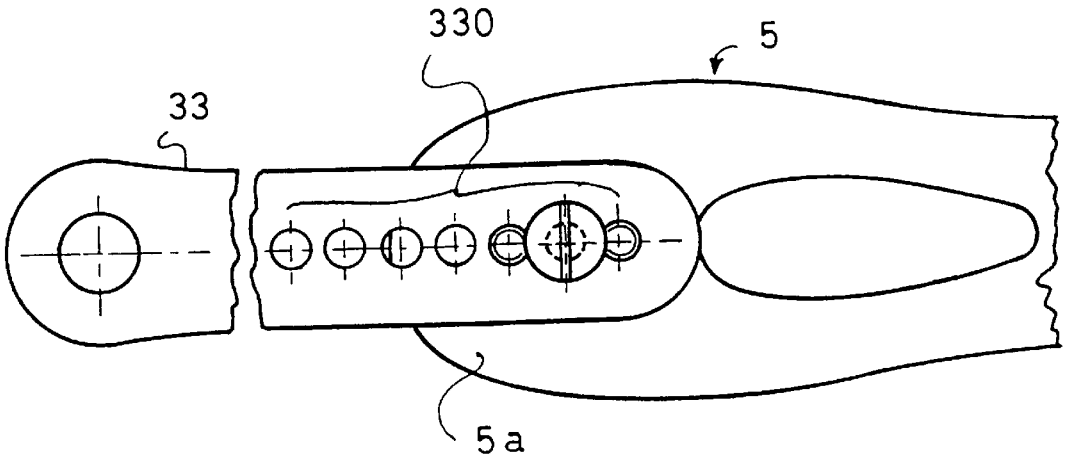
FIG. 6 is a partial top view of a strap portion according to a different embodiment of the invention.
Figure 7:
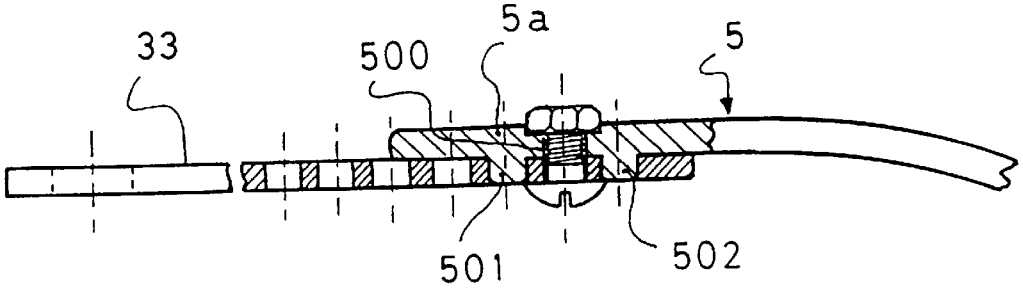
FIG. 7 is a side view of the strap portion represented in FIG. 6.

According to the variation represented in FIGS. 6 and 7, one of the serrated straps of the previous embodiment is replaced by a strap portion 33 including a series of holes 330 oriented in the lengthwise direction of the strap portion. As for the support element 5, at its end Sa it includes a collared hole 500 between two projections or pins 501, 502 forming the means that are engaged in the holes 330 of the strap portion. A removable affixing device of the screw/nut type passing through the hole 500 and one of holes 300 of the strap portion obtains the connection of the strap portion with element 5. The pins 501, 502 are positioned in the two holes on those strap portions that are adjacent to the affixing hole. Despite a slower adjustment, such a system has the advantage of immobilizing the support element in rotation with respect to the strap portion and allows the recovery of the substantial forces distributed over the three separate elements. The screw/nut affixing device could be replaced by a clip device so as to facilitate adjustment, for example.

The invention is not limited to only those particular embodiments that have been described as examples, but includes all equivalent embodiments falling within the scope of the claims that follow.

The instant application is based upon the French priority patent application No. 96 13491 filed on Oct. 31, 1996, the disclosure of which is hereby expressly incorporated by reference thereto, and the priority of which is hereby claimed under 35 USC 119.

What is claimed is:

1. A device for connecting a boot adapted to be attached to a glide board for snowboarding by means of at least one strap located in an instep zone of the boot, said strap comprising:

a relatively flexible and deformable inner padding element directed towards the boot, wherein the padding element of the strap includes a structural arrangement configured and positioned for distributing the tightening pressure exerted by strap on the instep of the boot, so as to obtain a central pressure corresponding to the zone of the big toe levator tendon, that is less than lateral pressures exerted on either side of the big toe levator tendon, wherein the pressure distribution arrangement of the strap on the padding element comprises a central hollowed space, demarcated laterally by two lateral projecting shapes arranged juttingly on either side of said central space, so as to constitute a housing for the tendon of the big toe.

2. A device as defined by claim 1, wherein the two lateral projecting shapes have a generally ovoid shape, centered at one point, whose peak is directed towards the central hollowed space so as to be ergonomically adapted to the bending fold of the instep.

3. A device for connecting a boot adapted to be attached to a glide board for snowboarding by means of at least one strap located in an instep zone of the boot, said strap comprising:

a relatively flexible and deformable inner padding element directed towards the boot, wherein the padding element of the strap includes a structural arrangement configured and positioned for distributing the tightening pressure exerted by strap on the instep of the boot, so as to obtain a central pressure corresponding to the zone of the big toe levator tendon, that is less than lateral pressures exerted on either side of the big toe levator tendon, said strap including a respective lateral zone on each of opposite sides of the central zone, the pressure distribution arrangement of the strap on the padding element being formed of materials whose components have varying densities, the material corresponding to the central zone having a lower density than the density of the material corresponding to the lateral zones, so as to constitute a central zone that is capable of being crushed in order to absorb the tendon of the big toe.

4. A device as defined by claim 1, wherein the strap comprises a support element along which said padding element is attached, at least on the inner said support element being all in one piece in the form of a traction resistant band.

5. A device as defined by claim 4, wherein the padding element is obtained by molding at least one foam element enveloped in a flexible envelope.

6. A device as defined by claim 4, further comprising means for affixing the padding element on the support element of said strap, said means comprising a stitch.

7. A device as defined by claim 4, further comprising means for affixing the padding element on the support element of said strap, said means comprising rivets.

8. A device as defined by claim 4, further comprising means for affixing the padding element on the support element of said strap, said means comprising adhesive.

9. A device as defined by claim 4, further comprising means for affixing the padding element on the support element of said strap, said means comprising high frequency welding.

10. A device as defined by claim 4, wherein said padding element is made by a duplicate molding undertaken directly on the support element of said strap.

11. A device for connecting a boot adapted to be attached to a glide board for snowboarding by means of at least one strap located in an instep zone of the boot, said strap comprising:

a relatively flexible and deformable inner padding element directed towards the boot, wherein the padding element of the strap includes a structural arrangement configured and positioned for distributing the tightening pressure exerted by strap on the instep of the boot, so as to obtain a central pressure corresponding to the zone of the big toe levator tendon, that is less than lateral pressures exerted on either side of the big toe levator tendon;

wherein the strap comprises a support element along which said padding element is attached, at least on the inner side said support element being all in one piece in the form of a traction resistant band; and said support element is interposed between two serrated strap portions so as to constitute a third central element thereof, whose ends are connected to the free ends of said serrated portions by means of two separate latching devices fixed on said ends.

12. A device for connecting a boot adapted to be attached to a glide board for snowboarding by means of at least one strap located in an instep zone of the boot, said strap comprising:

a relatively flexible and deformable inner padding element directed towards the boot, wherein the padding element of the strap includes a structural arrangement configured and positioned for distributing the tightening pressure exerted by strap on the instep of the boot, so as to obtain a central pressure corresponding to the zone of the big toe levator tendon, that is less than lateral pressures exerted on either side of the big toe levator tendon;

wherein the strap comprises a support element along which said padding element is attached, at least on the inner side said support element being all in one piece in the form of a traction resistant band; and wherein said support element is interposed between two strap portions, one of said two strap portions comprising a series of holes oriented in the lengthwise direction of said strap portion, said support element having an end comprising a collared hole between two pins thus forming means that are engaged in the holes of said strap portion, a removable affixing means passing through the hole, and one of the holes of the strap portion, thus forming the connection of the strap portion with the element.

13. A device as defined by claim 11, wherein said support element constituting the central portion of said strap is asymmetrical with respect to the median longitudinal axis, so as to make it reversible and so that each of the longitudinal sides offers a relative flexibility or stiffness in order to constitute the various supports selected by the user.

14. A device as defined by claim 13, wherein the asymmetrical padded reinforcement comprises a concave longitudinal side constituting the side where flexible support is taken and an opposing convex longitudinal side constituting the side where stiff support is taken.

15. A device for connecting a boot to a snowboard, said device comprising:

a shell to receive the boot, the shell being adapted to be secured to the snowboard;

at least one strap connected to said shell and extending across an instep zone of the boot;

a tightening device having a manually adjustable mechanism to tighten the strap and distribute a tightening pressure along the instep zone of the boot;

said strap including a structural arrangement for obtaining a greater tightening pressure in an area of said instep zone corresponding to the big toe levator tendon and lesser tightening pressures in areas of said instep zone lateral of said area of said instep zone corresponding to the big toe levator tendon, said structural arrangement including a support element and a relatively flexible and deformable inner padding element attached to an inner surface of said support element, said inner padding element including a hollowed space in said area of said instep zone corresponding to the big toe levator tendon.

16. A device for connecting a boot to a snowboard, said device comprising:

a shell to receive the boot, the shell being adapted to be secured to the snowboard:

at least one strap connected to said shell and extending across an instep zone of the boot;

a tightening device having a manually adjustable mechanism to tighten the strap and distribute a tightening pressure along the instep zone of the boot;

said strap including a structural arrangement for obtaining a greater tightening pressure in an area of said instep zone corresponding to the big toe levator tendon and lesser tightening pressures in areas of said instep zone lateral of said area of said instep zone corresponding to the big toe levator tendon, said structural arrangement including a support element and a relatively flexible and deformable inner padding element attached to an inner surface of said support element, said inner padding element including a material in said area of said instep zone corresponding to the big toe levator tendon having a density less than densities of material in said lateral areas of said instep zone.

17. A device for connecting a boot to a snowboard, said device comprising:

a shell to receive the boot, the shell being adapted to be secured to the snowboard;

at least one strap connected to said shell and extending across an instep zone of the boot;

a tightening device having a manually adjustable mechanism to tighten the strap and distribute a tightening pressure along the instep zone of the boot;

said strap comprising means for obtaining a greater tightening pressure in an area of said instep zone corresponding to the big toe levator tendon and lesser tightening pressures in areas of said instep zone lateral of said area of said instep zone corresponding to the big toe levator tendon.

18. A device as defined by claim 3, wherein the strap comprises a support element along which said padding element is attached, at least on the inner side, said support element being all in one piece in the form of a traction resistant band.

19. A device as defined by claim 18, wherein the padding element is obtained by molding at least one foam element enveloped in a flexible envelope.

20. A device as defined by claim 18, further comprising means for affixing the padding element on the support element of said strap, said means comprising a stitch.

21. A device as defined by claim 18, further comprising means for affixing the padding element on the support element of said strap, said means comprising rivets.

22. A device as defined by claim 18, further comprising means for affixing the padding element on the support element of said strap, said means comprising adhesive.

23. A device as defined by claim 18, further comprising means for affixing the padding element on the support element of said strap, said means comprising high frequency welding.

24. A device as defined by claim 18, wherein said padding element is made by a duplicate molding undertaken directly on the support element of said strap.

25. A device as defined by claim 18, wherein said support element is interposed between two serrated strap portions so as to constitute a third central element thereof, whose ends are connected to the free ends of said serrated portions by means of two separate latching devices fixed on said ends.

26. A device as defined by claim 18, wherein said support element is interposed between two strap portions, one of said two strap portions comprising a series of holes oriented in the lengthwise direction of said strap portion, said support element having an end comprising a collared hole between two pins thus forming means that are engaged in the holes of said strap portion, a removable affixing means passing through the hole, and one of the holes of the strap portion, thus forming the connection of the strap portion with the element.

27. A device as defined by claim 25, wherein said support element constituting the central portion of said strap is asymmetrical with respect to the median longitudinal axis, so as to make it reversible and so that each of the longitudinal sides offers a relative flexibility or stiffness in order to constitute the various supports selected by the user.

28. A device as defined by claim 27, wherein the asymmetrical padded reinforcement comprises a concave longitudinal side constituting the side where flexible support is taken and an opposing convex longitudinal side constituting the side where stiff support is taken.

29. A device as defined by claim 4, wherein said support element is interposed between two serrated strap portions so as to constitute a third central element thereof, whose ends are connected to the free ends of said serrated portions by means of two separate latching devices fixed on said ends.

30. A device as defined by claim 4, wherein said support element is interposed between two strap portions, one of which comprises a series of holes oriented in the lengthwise direction of said strap portion, while the support element comprises, at its end a collared hole between two pions thus forming means that are engaged in the holes of said strap portion, a removable affixing means passing through the hole, and one of the holes of the strap portion, thus forming the connection of the strap portion with the element.

31. A device as defined by claim 29, wherein said support element constituting the central portion of said strap is asymmetrical with respect to the median longitudinal axis, so as to make it reversible and so that each of the longitudinal sides offers a relative flexibility or stiffness in order to constitute the various supports selected by the user.

32. A device as defined by claim 31, wherein the asymmetrical padded reinforcement comprises a concave longitudinal side constituting the side where flexible support is taken and an opposing convex longitudinal side constituting the side where stiff support is taken.

33. A device according to claim 17, wherein:

said means comprises a support element and a relatively flexible and deformable inner padding element attached to an inner surface of said support element.

34. A device according to claim 33, wherein:

said inner padding element includes a hollowed space in said area of said instep zone corresponding to the big toe levator tendon.

35. A device according to claim 33, wherein:

said inner padding element includes a material in said area of said instep zone corresponding to the big toe levator tendon having a density less than densities of material in said lateral areas of said instep zone.

36. A device for connecting a boot adapted to be attached to a glide board for snowboarding by means of at least one strap located in an instep zone of the boot, said strap comprising:

a relatively flexible and deformable inner padding element directed towards the boot, wherein the padding element of the strap comprises means for distributing the tightening pressure exerted by strap on the instep of the boot, so as to obtain a central pressure corresponding to the zone of the big toe levator tendon, that is less than lateral pressures exerted on either side of the big toe levator tendon.

* * * * *